US006652329B1

(12) United States Patent
Howell et al.

(10) Patent No.: US 6,652,329 B1
(45) Date of Patent: Nov. 25, 2003

(54) TERMINALS FOR AN ELECTRICAL SOCKET

(75) Inventors: David Gregory Howell, Gilbert, AZ (US); Ming-Lun Szu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/166,890

(22) Filed: Jun. 10, 2002

(51) Int. Cl.[7] ..... H01R 4/48
(52) U.S. Cl. ..... 439/862
(58) Field of Search ..... 439/342, 862, 439/83, 876, 733.1, 74, 66

(56) References Cited

U.S. PATENT DOCUMENTS 4,750,891 A * 6/1988 Egawa ..... 439/259
4,917,614 A * 4/1990 Kikuchi et al. ..... 439/83
5,213,513 A * 5/1993 Brown et al. ..... 439/862
5,518,426 A * 5/1996 Plainer ..... 439/856
5,860,838 A * 1/1999 Kaneko ..... 439/857
5,989,049 A * 11/1999 Walkup et al. ..... 439/862
6,086,401 A * 7/2000 Hsiung et al. ..... 439/862
6,227,869 B1 * 5/2001 Lin et al. ..... 439/66

* cited by examiner

*Primary Examiner*—Gary Paumen
(74) *Attorney, Agent, or Firm*—Wei Te Chung

(57) ABSTRACT

A conductive terminal (1) used for an electrical socket comprises a retaining body (10) retained to a terminal hole (24) of the base of an electrical socket (2), a soldering portion (12) and a resilient arm (16) both extending from the retaining body. The retaining body is parallel to one lateral side of the base during insertion into the base. The resilient arm has a body portion (17) connected to one side (13) of the retaining body and a curved beam (18) conductively contacting with an upper printed circuit board. An angle ($\alpha$) defined between the retaining body and the body portion of the resilient arm is an obtuse angle so that the curved beam extends substantively in a diagonal direction (W) of a corresponding terminal hole.

4 Claims, 6 Drawing Sheets

TERMINALS FOR AN ELECTRICAL SOCKET

BACKGROUND OF THE INVENTION

1. Field of the Invention

The present invention relates to a terminal for use in an electrical socket, and particularly to such a terminal which not only has a good desired performance but also can be easily assembled to the electrical socket.

2. Description of Prior Art

With the miniature trend in computer technology, electrical sockets each of which mainly comprises an insulating housing and a plurality of terminals are becoming smaller and smaller. Due to their small size, the terminals, especially mating beams of the terminals are easily to be damaged because of overlarge stress produced therein when the terminals engage with pins of a complementary electronic package, such as a central processing unit (CPU). Several methods are proposed to solve this problem. One of them, for example as that disclosed in U.S. Pat. Nos. 5,860,838, and 6,227,869, is to modify the structure of the terminals so as to obtain optimal electrical and mechanical performance of the mating beams of the terminals. Another method is to modify the arrangement of the terminals with respect to a base of an insulating housing of the sockets, as disclosed in U.S. Pat. Nos. 4,750,891, and 5,518,426. As disclosed in U.S. Pat. No. 4,750,891, a base plate of an electrical socket defines an array of terminal holes arranged in a lattice-like shape for receiving corresponding terminals therein and the respective rows of the terminal holes are inclined at same angles, preferably 45 degrees, with respect to the respective sides of the base. In this way, not only miniaturization of the pith of adjacent terminals is advanced, but also intended performance of the terminal is obtained. However, the terminals can not be fitted into the lattice-shaped terminal holes of the base plate simultaneously, due to the limitation of existing manufacturing technology for the terminals, thereby complicating the assembly of the terminals. Furthermore, in forming the terminal holes oriented in 45 degrees, core pins of the molding mold should also be oriented in 45 degrees. This introduces a lot of complication in forming the molding mold. On the other hand, U.S. Pat. No. 4,917,614 defines some approach to use a 45 degrees contact in a connector for surface mount to a printed circuit board.

Hence, an improved terminal for use in an electrical socket is required to overcome the disadvantages of the prior art.

BRIEF SUMMARY OF THE INVENTION

A main object of the present invention is to provide a conductive terminal for use in an electrical socket, wherein the terminal has good intended performance and can be easily assembled in the socket.

To fulfill the above-mentioned object, a conductive terminal for use in an electrical socket in accordance with the present invention comprises a retaining body retained to a base of an insulating housing of the electrical socket, a soldering portion and a resilient arm both extending from the retaining body. The retaining body is parallel to one lateral side of the base during insertion into the base. The soldering portion extends horizontally from a bottom end of the retaining body for soldering to a printed circuit board. The resilient arm has a body portion connected to one side of the retaining body and a curved beam for conductively contacting with a conductive point of an electronic package. An angle is defined between the retaining body and the body portion of the resilient arm. The angle is an obtuse angle so that the curved beam extends substantially in a diagonal direction of a corresponding terminal hole receiving the terminal, whereby the curved beam can obtain an extended length.

Other objects, advantages and novel features of the invention will become more apparent from the following detailed description of the present embodiment when taken in conjunction with the accompanying drawings.

DETAILED DESCRIPTION OF THE INVENTION

Figure 1:
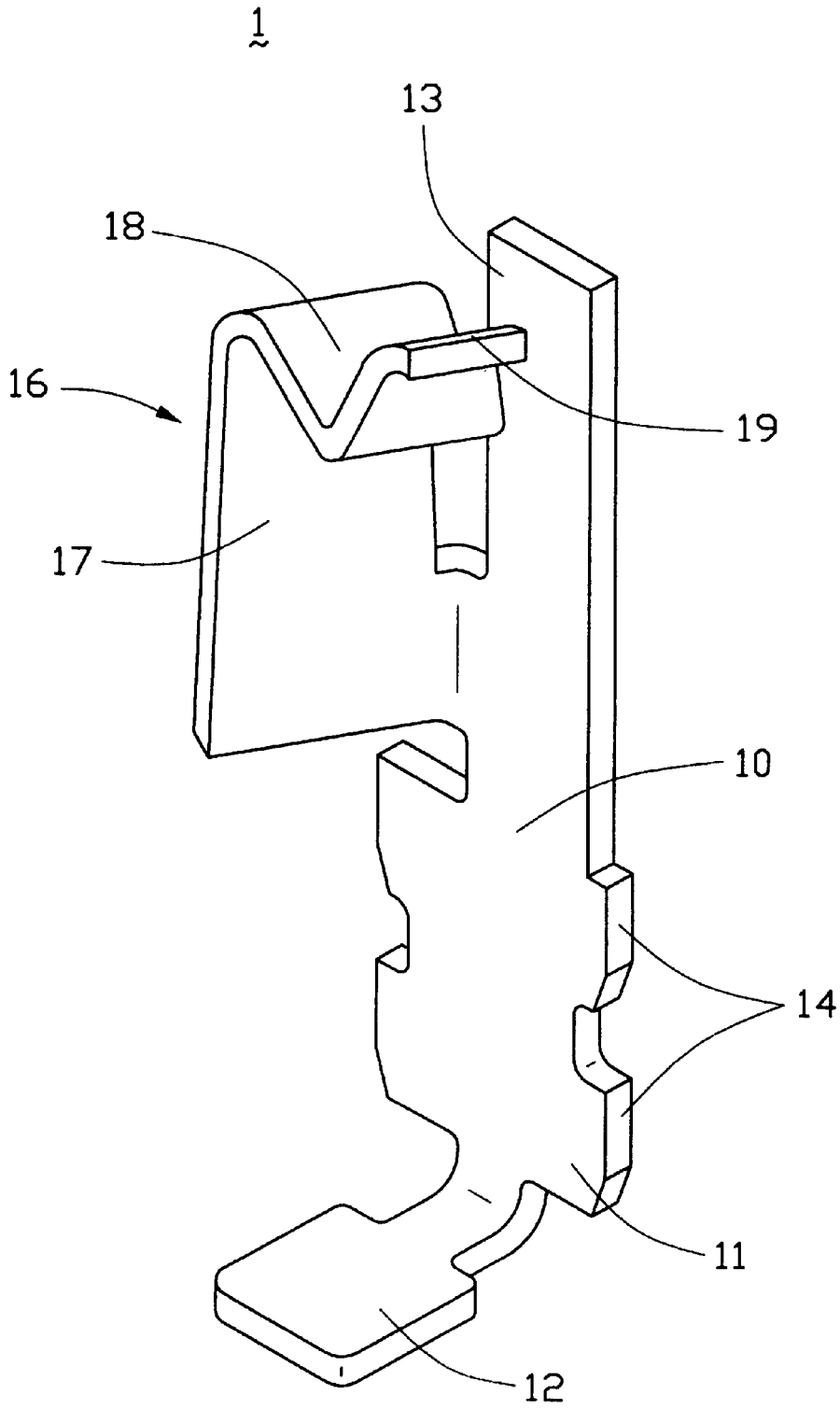
FIG. 1 is a perspective view of a terminal for use in an electrical socket in accordance with the present invention.
Figure 2:
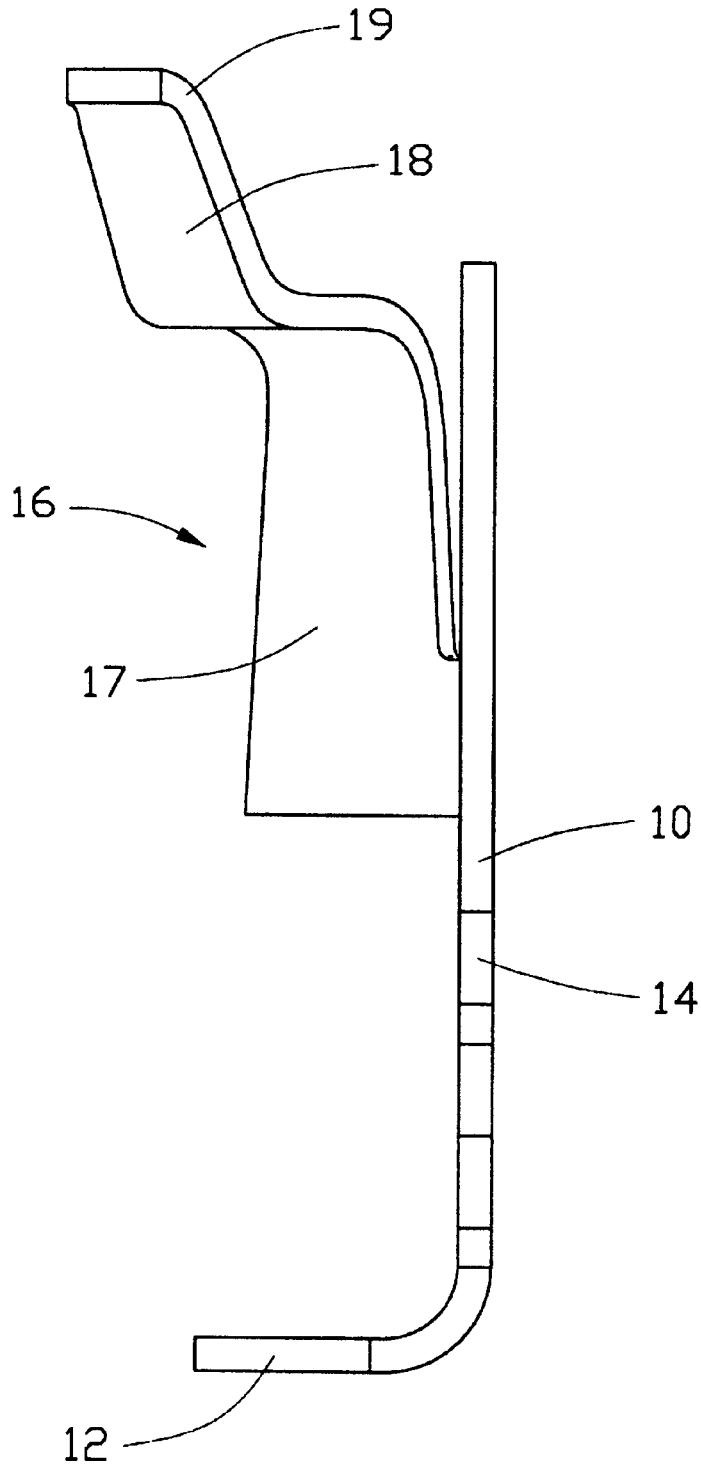
FIG. 2 is a side view of FIG. 1.
Figure 3:
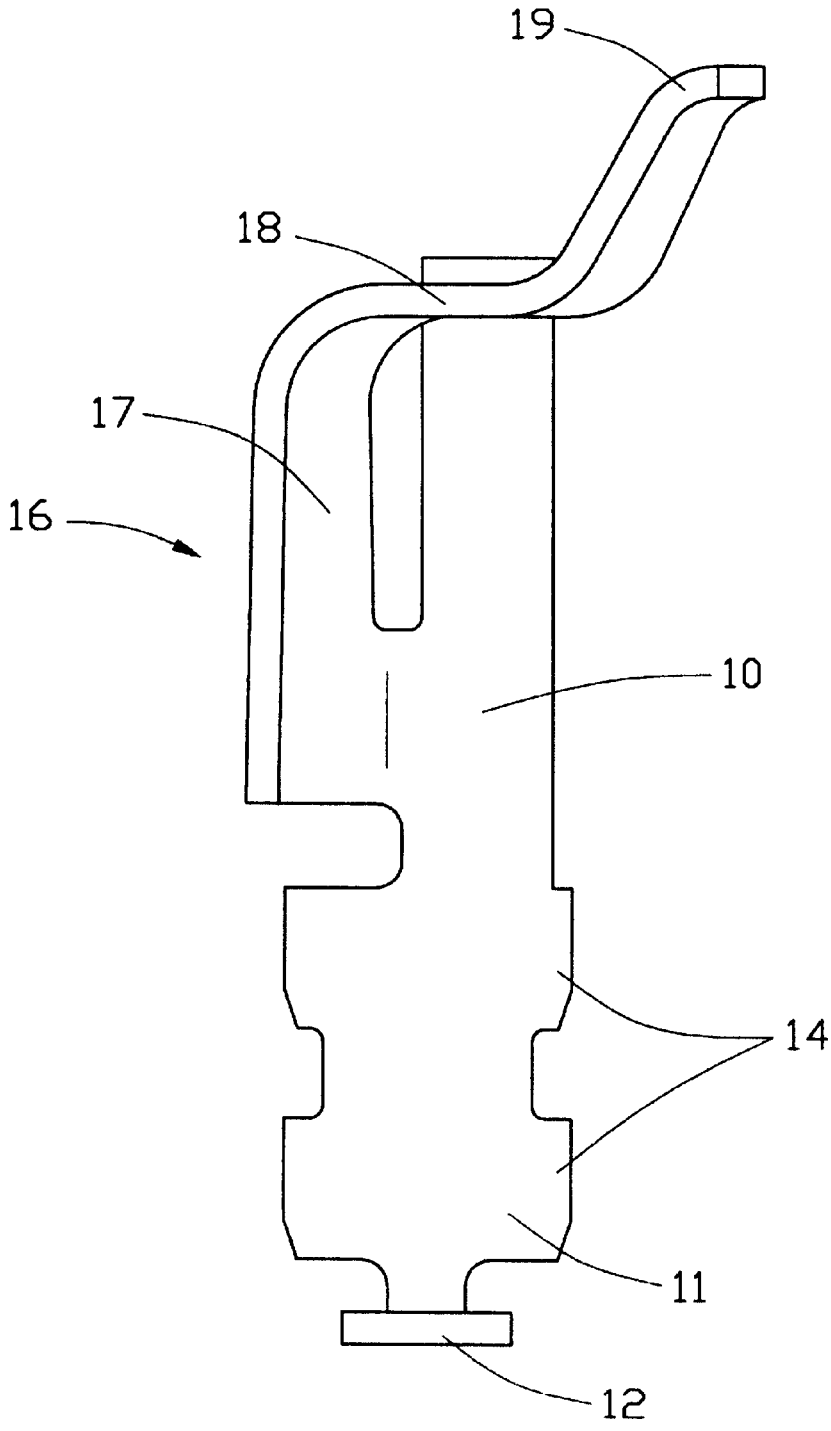
FIG. 3 is a front view of FIG. 1.

Referring to FIG. 1, there is shown a perspective view of a conductive terminal 1 incorporating inventive features of the present invention. The terminal 1 is used for an electrical socket, such as an LGA (Land Grid Array) socket, and electrically connects between an upper and a lower printed circuit boards (PCBs) (not shown).

Further referring to FIGS. 2 to 5, the terminal 1 has a retaining body 10, a soldering portion 12 horizontally extending from a lower end 11 of the retaining body 10 for soldering to the lower printed circuit board, and a resilient arm 16 extending from a lateral side 13 of the retaining body 10, in which an obtuse angle $\alpha$ is formed between a body portion 17 of the resilient arm 16 and the retaining body 10. The angle $\alpha$ preferably is 145 degrees. The retaining body 10 forms a plurality of barbs 14 at opposite sides 13 thereof, adjacent to the lower end 11 thereof, for retaining the terminal 1 to a terminal hole 24 (FIG. 6) of a base 22 of an insulting housing of the electrical socket 2.

Figure 4:
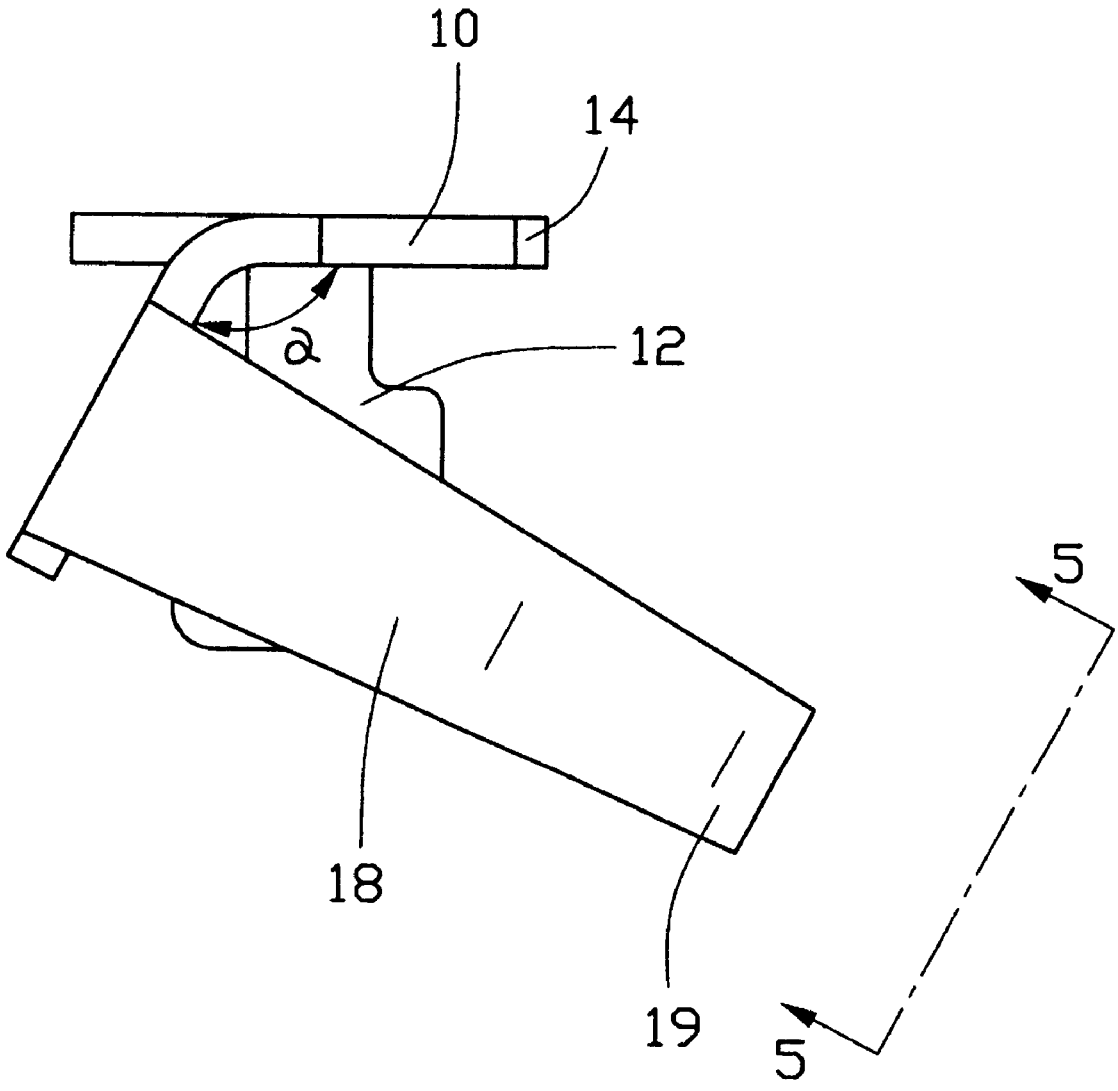
FIG. 4 is a top view of FIG. 1.
Figure 5:
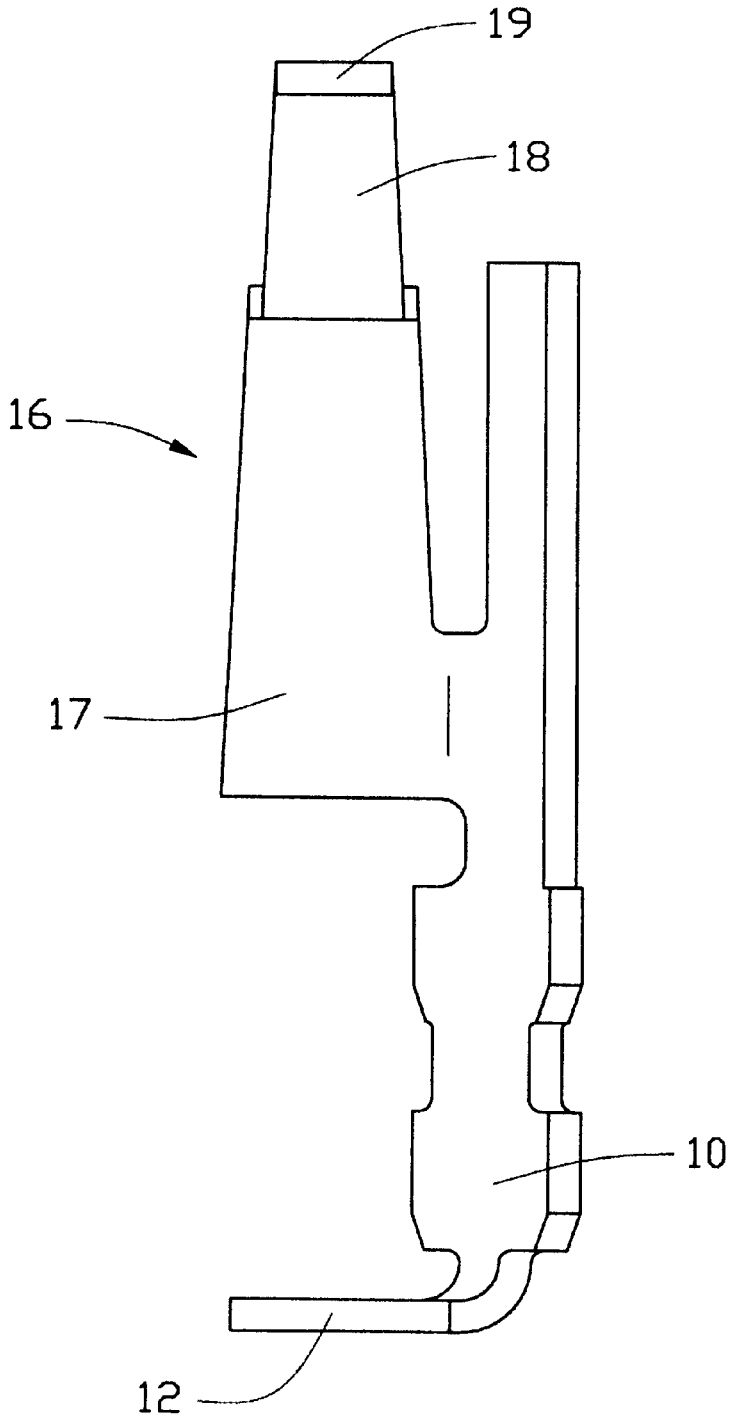
FIG. 5 is an elevational view viewed from a direction indicated by a double-arrow line 5—5 of FIG. 4.
Figure 6:
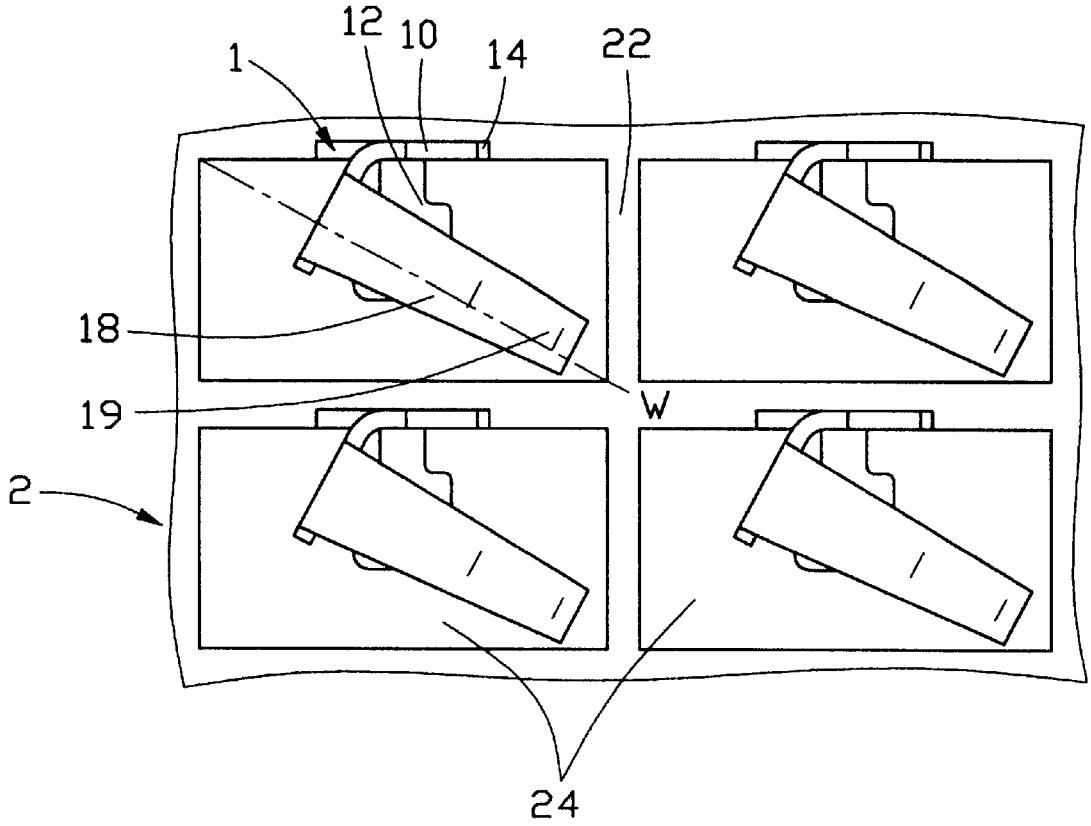
FIG. 6 is a partial top view of the electrical socket of the present invention, having a number (four) of the terminals of FIG. 1 assembled to a base thereof.

The resilient arm 16 has the body portion 17 and a curved beam 18 extending from an upper end of the body portion 17. The resilient arm 16 tapers off from a lower end thereof to an upper end thereof, as best seen in FIG. 4. The curved beam 18 forms an arc free end 19 to conductively contact a corresponding conductive point (not shown) formed on the upper PCB when the upper PCB presses the arc free end 19 downward. Thus, the curved beam 18 needs a length which is sufficiently long to bear the stress generated by the downward pressing force from the upper PCB. To fulfill this demand, as best seen in FIG. 6, the angle a, which is defined between the body portion 17 and the retaining body 10, is an obtuse angle (145 degrees) in accordance with the preferred embodiment of the present invention. By this arrangement, the curved beam 18 extends substantively in a diagonal direction W of a corresponding terminal hole 24 of the base 22 of the socket 2 so as to obtain its possibly maximal length in the hole 24, whereby the curved beam 18 can more effectively resist the stress generated by the depressing force of the upper PCB.

In assembly, referring to FIG. 6, the terminals 1 extend from a common contact carrier (not shown) are inserted simultaneously from above of the base 22 into corresponding terminal holes 24 of the base 22. It is noted that during this insertion course, the retaining bodies 10 of the terminals 1 are parallel to two corresponding opposite side edges (not shown) of the base 2 and a longitudinal direction of the holes 24. Thus, the assembly of the terminals 1 to the base 2 in accordance with the present invention is just a single operation, which is more simple with respect to the assembly of the terminals in the prior art. Meanwhile, each of the resilient arms 18 extends in the diagonal direction W of a corresponding hole 24. Thus, the curved beams 18 of the terminals 1 in accordance with the present invention can provide sufficient resiliency to meet the operational requirement in mating the upper PCB with the electrical socket 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A conductive terminal adapted for use in an electrical socket comprising:

a retaining body adapted to be retained to an insulating base of the electrical socket;

a soldering portion extending from a lower end of the retaining body adapted for soldering to a lower printed circuit board; and only one resilient arm having a body portion extending from a side of the retaining body and a curved beam extending from a top end of the body portion and adapted for conductively contacting with an upper printed circuit board;

wherein an angle is defined between the retaining body and the body portion of the resilient arm and is not a right angle;

wherein the retaining body forms a plurality of barbs on opposite sides thereof, adapted to engage with the base;

wherein the angle between the retaining body and the body portion of the resilient arm is generally 145 degrees;

wherein the resilient arm is tapered from its lower end to its upper end;

wherein the curved beam forms an arc free end adapted to conductively contact a corresponding conductive point formed on the upper printed circuit board;

wherein the soldering portion extends horizontally from the lower end of the retaining body.

2. An electrical socket for being electrically connected between two upper and lower circuit boards, comprising:

a base defining a plurality of terminal holes; and a plurality of conductive terminals being simultaneously inserted into the terminal holes and each having a retaining body, a soldering portion for soldering to a lower circuit board, and only one resilient arm for conductively contacting an upper circuit board and having a body portion extending from the retaining body;

wherein an angle defined between the body portion and the retaining body is not a right angle;

wherein the terminals are simultaneously inserted into corresponding terminal holes of the base and the retaining bodies thereof are substantively parallel to a side edge of the base of the electrical socket;

wherein the retaining body forms a plurality of barbs on opposite sides thereof to be retained to the terminal hole of the base, wherein the angle between the retaining body and the body portion of the resilient arm is an obtuse angle;

wherein the resilient arm is tapered from its lower end to its upper end, wherein a curved beam extends wavily and upwardly from the body portion and substantively in one diagonal direction of a corresponding terminal hole of the base;

wherein the curved beam forms an arc free end to conductively contact a contact point formed on the upper printed circuit board;

wherein the soldering portion extends horizontally from the one end of the retaining body.

3. An electrical socket for use with opposite upper and lower printed circuit boards sandwiching said socket therebetween, comprising:

a base defining a plurality of terminals holes;

a plurality of conductive terminals disposed in said terminals holes, respectively, each of said terminals including:

a retaining body, for retaining the terminal to the base, defining a plane along either a longitudinal direction or a transverse direction of the base;

a lower contact portion extending from a lower portion of the retaining body for contacting the lower printed circuit board; and an upper contact portion extending from an upper portion of the retaining body for contacting the upper printed circuit board; wherein an engagement portion of said upper contact portion, including the engagement end thereof, essentially extends in a direction at an angle which is not parallel to either said longitudinal direction or said transverse direction.

4. The socket as claimed in claim 3, wherein the whole said upper contact portion is angled not along said longitudinal direction or said transverse direction.

* * * * *